United States Patent [19]

Marshall

[11] 4,376,802

[45] Mar. 15, 1983

[54] FINISH COMPOSITION FOR POLYESTER YARN

[75] Inventor: Robert M. Marshall, Chester, Va.

[73] Assignee: Allied Corporation, Morris Township, Morris County, N.J.

[21] Appl. No.: 114,819

[22] Filed: Jan. 24, 1980

[51] Int. Cl.[3] ..... D06M 15/10; D06M 15/52; D06M 15/58; D06M 15/70

[52] U.S. Cl. ..... 428/378; 28/166; 28/178; 57/250; 57/295; 427/389.9; 427/393.1; 427/393.2; 428/395

[58] Field of Search ..... 428/378, 395; 252/8.9, 252/8.7, 8.8 R, 8.6, 8.8 C, 8.8 G, 8.8 Q; 28/178, 166; 57/250; 427/389.9, 393.1, 393.2

[56] References Cited

U.S. PATENT DOCUMENTS

| | | | |
|---|---|---|---|
| 2,653,140 | 9/1953 | Allenby et al. . | |
| 2,819,179 | 1/1958 | Barnard et al. . | |
| 2,839,506 | 6/1958 | Cooke et al. . | |
| 3,102,042 | 8/1963 | Gortvai et al. . | |
| 3,116,263 | 12/1963 | Enders et al. . | |
| 3,140,197 | 7/1964 | Heberlein et al. . | |
| 3,161,594 | 12/1964 | White et al. . | |
| 3,275,402 | 9/1966 | Daul et al. . | |
| 3,313,645 | 4/1967 | Wagner et al. . | |
| 3,374,107 | 3/1968 | Cotton . | |
| 3,484,182 | 12/1969 | Hartgrove et al. . | |
| 3,660,011 | 5/1972 | Shippee et al. . | |
| 3,664,381 | 5/1972 | Ibach et al. . | |
| 3,672,977 | 6/1972 | Dardoufas | 428/395 |
| 3,690,942 | 9/1972 | Vandermaas et al. . | |
| 3,709,657 | 1/1973 | Hollies et al. . | |
| 3,709,716 | 1/1973 | Liggett . | |
| 3,870,555 | 3/1975 | Swidler et al. . | |
| 3,899,469 | 8/1975 | Buhler et al. . | |
| 3,920,881 | 11/1975 | Roth . | |
| 3,989,457 | 11/1976 | Marte . | |
| 4,039,496 | 11/1977 | Hermann . | |
| 4,061,465 | 12/1977 | Franklin et al. . | |
| 4,088,592 | 5/1978 | Smith . | |
| 4,092,251 | 5/1978 | Smith . | |
| 4,104,443 | 8/1978 | Latta et al. . | |
| 4,134,841 | 1/1979 | Park et al. . | |

FOREIGN PATENT DOCUMENTS 1336063 11/1973 United Kingdom .

OTHER PUBLICATIONS

C.A. 63:96780 (1968).
C.A. 73:121494 (1970).
C.A. 82:59843 (1975).
C.A. 83:195171 (1975).
C.A. 85:64746 (1976).
C.A. 85:161842 (1976)
C.A. 85:161843 (1976).
C.A. 87:40698 (1977).
C.A. 87:13727 (1977).
C.A. 87:153369 (1977).
Derwent 50429v/28 DT 2259–680.
Derwent 18372b/10 DT 2737–423.
Derwent Japanese, vol. 5, No. 46 (1966), 19,639/66.

*Primary Examiner*—James C. Cannon
*Attorney, Agent, or Firm*—Virginia S. Andrews

[57] ABSTRACT

A fiber finish composition, a method of formulating the same, a process for treating yarn therewith and yarn so treated are all disclosed. The fiber finish composition, which is applied as an overfinish to the yarn after drawing of the yarn, comprises about 24 to 86.4 weight percent of water, about 10 to 50 weight percent of a stiffener selected from the group consisting of triazines, melamine and urea-formaldehyde resins, about 3 to 20 weight percent of a water soluble lubricant, about 0.4 to 5 weight percent of a catalyst for the stiffener, and about 0.2 to 1 weight percent of a wetting agent. Polyester yarn so treated and woven in the filling direction to form a seat belt stiffens, or reduces the pliability of, the belt to inhibit curling of the belt in the retractor housing.

42 Claims, No Drawings

FINISH COMPOSITION FOR POLYESTER YARN

BACKGROUND OF THE INVENTION

1. Field of the Invention

The present invention relates to a fiber finish composition, to a method of formulating the same, to a process for treating yarn therewith and to yarn treated therewith. More particularly, the present invention relates to a fiber finish composition for application to polyester, preferably polyethylene terephthalate, yarn after drawing of the yarn; the yarn is subsequently twisted into cord which is utilized in at least one weaving direction of a woven fabric, preferably seat belt fabric, which is exposed for an effective time period to a temperature which causes the finish composition to stiffen the fabric.

2. Description of the Prior Art

Polyester fabrics woven with a needle loom have a tighter and denser construction than those woven with a conventional shuttle loom; the denser weave is due to the greater number of picks per inch. The polyester fabrics woven with a shuttle loom have a tendency to roll or curl due to the loose weave. A seat belt formed from such a fabric often experiences curling, usually inwardly along its length, in the seat belt retractor housing where it can get caught. The present invention has been developed to avoid this problem and consequently to avoid the expense of investing in a needle loom or looms.

SUMMARY OF THE INVENTION

The present invention provides a fiber finish composition, a method of formulating the same, a process for treating yarn therewith and yarn so treated.

The fiber finish composition comprises about 24 to 86.4 percent of water, about 10 to 50 weight percent of a stiffener selected from the group consisting of triazines, melamine and urea-formaldehyde resins, about 3 to 20 weight percent of a water-soluble lubricant, about 0.4 to 5 weight percent of a catalyst for the stiffener, and about 0.2 to 1 weight percent of a wetting agent. The composition, hereinafter called the stiffener-containing finish, is applied to polyester yarn, preferably polyethylene terephthalate yarn, prepared by a process involving spinning and drawing steps as an overfinish after drawing the yarn.

The method of formulating the stiffener-containing fiber finish composition comprises the steps of:

(a) adding either the water-soluble lubricant or the wetting agent to the water;

(b) then adding either the water-soluble lubricant or the wetting agent, whichever was not added initially, thereto;

(c) then adding the stiffener or the catalyst thereto; and (d) finally adding the stiffener or the catalyst, whichever has not been previously added, thereto.

The synthetic filamentary yarn of the present invention is comprised of polyester filaments which are treated with from about 1.2 to 7.0, more preferably about 2.5 to 3.0, weight percent based on the weight of the yarn of the liquid fiber finish composition described above.

The present invention also provides an improvement in a process for the production of a woven fabric wherein the cords of at least one weaving direction of the fabric, preferably the filling direction, are made from a polyester yarn which is prepared by a process involving spinning and drawing steps. The improvement comprises the steps of:

(a) treating the yarn subsequent to the drawing step, with from about 1.2 to 7.0, more preferably from about 2.5 to 3.0, weight percent based on the weight of the yarn of the stiffener-containing fiber finish composition described above;

(b) twisting the yarn into cord;

(c) weaving a fabric which utilizes the treated cords in at least one weaving direction, preferably the filling direction; and (d) exposing the fabric for an effective time period, preferably 1 to 1.5 minutes, to a temperature which causes the composition to stiffen the fabric without damaging the fiber, preferably a temperature of at least about 171° C. (340° F.). The maximum temperature to be utilized should not damage the fibers, e.g., about 240° C. It is preferred that the process improvement further comprise the step of treating the yarn during the spinning step (prior to drawing) with from about 0.3 to about 0.6 weight percent based on the weight of the yarn of a liquid composition comprising about 10 to 20 weight percent of isohexadecyl stearate, about 10 to 20 weight percent of refined coconut oil, about 3 to 6 weight percent of ethoxylated lauryl alcohol, about 8 to 12 weight percent of a petroleum sulfonate, about 1 to 3 weight percent of a salt of dinonyl sulfosuccinate, and about 35 to 50 weight percent of white mineral oil having a boiling point of between about 265° C. (510° F.) and 327° C. (620° F.) and a viscosity of about 38 to 40 SUS at about 38° C. (100° F.) wherein at least about 0.15 to about 0.30 weight percent is retained on the yarn.

The yarn of the present invention has also preferably been treated with from about 0.3 to 0.6 weight percent of the first finish composition of the two-part fiber finish composition prior to treatment with the stiffener-containing fiber finish composition.

The preferred stiffener is a modified melamine urea resin. The water-soluble lubricant is preferably selected from the group consisting of polyoxyalkylene ethers, ethoxylated esters, polyalkylene glycols and diesters. The most preferred water-soluble lubricant is a polyalkylene glycol ether. The catalyst for the stiffener is preferably an aqueous solution of magnesium chloride or zinc chloride, more preferably the former. The wetting agent is preferably either a salt of dinonyl sulfosuccinate or polyoxyethylene 9–10 octylphenol, more preferably the former.

Certain processes and tests utilized in illustrating this invention are defined below. First, the Thermasol Process for dyeing fabric or webbing made with polyester yarn is carried out as follows:

Thermasol Process

1. Pad on disperse dyestuffs at temperatures up to 140° F. (60° C.).
2. Pass dye-impregnated webbing through infra-red pre-dryer.
3. Dry in air drier at 230°–250° F. (110°–130° C.).
4. Pass through Thermasol oven for 2 minutes at 374°–430° F. (190°–221° C.).
5. Pad on 2 gpl caustic soda and 2 gpl sodium hydrosulfite 80° F. (27° C.).
6. Steam 2–8 minutes.
7. Wash with synthetic detergent at 205°–212° F. (96°–100° C.) 2 or more boxes.
8. Hot water rinse 205°–212° F.

9. Rinse in a cold solution of 5 gpl acetic acid (56%).
10. Dry in hot air oven and/or steam cans 250° F. (130° C.).

1. Caustic/hydrosulfite reduction can be accomplished in a multi-pass wash box if a steamer is not available.

2. The use of pressure water sprays on webbing and/or webbing vibrators in each wash box has been found to effectively improve crockfastness.

Note: Tension should be maintained on each strand of fabric or webbing during the dyeing procedure to reduce processing shrinkage.

Pliability of Seat Belt Webbing

This procedure is identified as Test Method 30–35 dated Jan. 30, 1975, and is available from Fisher Body Division, General Motors Corporation, General Offices, Warren, Mich. 48090, as are copies of the drawings and figures referenced in the procedure.

I. General Description

This procedure is used to determine the pliability of seat belt webbing.

II. Equipment Required

A. Fill Direction

1. Pliability Test Stand (Drawing 74XP-07006).
2. Dial Indicator (Federal Products Corporation, Providence, R.I.), Model D-81-S, low friction, full jewelled bearing. The following modifications must be made on the Dial Indicator.
   a. Remove Rack Spring.
   b. Remove Hair Spring and Hair Spring Pin on Take-up Gear Assembly.
   c. Remove lower point and substitute the Contact Foot (See Drawing 74XP-07006-5).
   d. Remove Rack Stop Screw and replace with Rod-Indicator Top (Drawing 74XP-07006-2).
3. Specimen Fixture (Drawing 74XP-07006-4).
4. Weight (Drawing 74XP-07006-1).
5. Clamp—Indicator Rod (Drawing 74XP-07006-3).
6. Timer in tenths of a second (Precision Scientific Catalogue 69230 or equivalent).
7. Dowel-22 mm×152 mm (⅞"×6") wood.
8. Dowel-13 mm×152 mm (½"×6") wood.
9. Adjustable Air-Damping Dashpot, Part No. 500461-1 (obtainable from Airpot Corporation, 27 Lois Street, Norwalk, Conn. 06851) or Fisher Body approved equivalent.

B. Warp Direction

1. Pliability test stand (Drawing 75XP-06550). This stand must be mounted securely on the edge of a table or counter with the rods overhanging the edge (belted, clamped, etc.).
2. 110 g weight.

III. Procedure

A. Fill Direction

1. Seat Belt webbing is exposed for a minimum of two (2) hours to a temperature of 70° F. (21° C.) and 65% relative humidity. (Note that this is a modification to the standard procedure which states: "Condition samples in accordance with Fisher T. M. 32-1.")
2. Six (6) specimens 76 mm (3") by the width of the webbing are required for the test, three (3) for testing the webbing with the twill side toward the operator and three (3) for testing the webbing with the twill side away from the operator.
3. Take a sample and with the twill side toward the operator, wrap the 76 mm (3") length around a 22 mm (⅞") dowel until both ends meet.
4. Repeat "3" with the twill side away from the operator.
5. Take the above sample and with the twill side toward the operator, wrap the width around a 13 mm (½") dowel until both edges meet.
6. Repeat "5" with the twill side away from the operator.
7. Insert the webbing twill side toward the operator into the specimen holder without any unnecessary flexing. Two ways seem suitable:
   a. From an open end, locate the webbing in the 6.5 mm (0.25") slots, one slot at a time, pushing the webbing across the width of the holder.
   b. From an open end, locate the entire length of the webbing in the lower 6.5 mm (0.25") slots. Lift the webbing with both hands and locate the both upper slots simultaneously.
8. Lift rack and contact foot (FIG. 2, Detail No. 1) and locate the specimen holder (with the sample on the test stand) within the guides.
9. Release the contact foot at a speed of 3.5 seconds per 25 mm (1") travel.
10. As the foot comes in contact with the edge of the webbing, start the timer.
11. When the timer indicates 60 seconds, observe the reading as indicated on the dial gauge and record.
12. Repeat Steps "3" through "11" for the remaining two "twill toward the operator" samples.
13. Repeat Steps "3" through "11" for the three "twill away from the operator" samples.
14. Report result as the average pliability of all six (6) samples tested.

NOTE: The distance between the bottom of the foot assembly (in its lowest position) and the top surface of the test stand shall be 25 mm (1") exactly.

B. Warp Direction

1. Two (2) specimens 180 mm (7") by the width of the webbing are required for the test.
2. Samples must be flexed prior to testing. This is done in the following manner:
   a. Bend both ends of sample downward until they meet and form a loop.
   b. Slip loop over center post on test stand, release ends of webbing.
   c. Grasp ends of sample firmly and pull up at a 45° angle (approximately).
   d. One flex cycle consists of pulling one side of webbing at a 45° angle as far as possible without letting the other end slip through the rods. Then pull the other (short) end up in the same manner.
   e. The sample should be flexed for three (3) complete cycles. After the last cycle the sample is pulled completely through the rods until it is free.
3. To test webbing, position flexed sample in slots of test stand with equal clearance on each side. Place the 100 g weight across the center of the sample (the weakest point)—do not drop. Test sample on both sides.

DESCRIPTION OF THE PREFERRED EMBODIMENT

In order to demonstrate the invention, the following examples are given. They are provided for illustrative purposes only and are not to be construed as limiting the scope of the invention, which is defined by the appended claims. Specifically, it is believed that there are other spin finishes which would perform as satisfactorily as the one detailed. In these examples, parts and percentages are by weight unless specified otherwise.

The yarns of this invention can be processed by any spin draw process or spinning and separately drawing process available to the art in the patent and technical literature, using any suitable polyester.

The preferred polyesters are the linear terephthalate polyesters, i.e., polyesters of a glycol containing from 2 to 20 carbon atoms and a dicarboxylic acid component containing at least about 75% terephthalic acid. The remainder, if any, of the dicarboxylic acid component may be any suitable dicarboxylic acid such as sebacic acid, adipic acid, isophthalic acid, sulfonyl-4,4'-dibenzoic acid, or 2,8-di-benzofurandicarboxylic acid. The glycols may contain more than two carbon atoms in the chain, e.g., diethylene glycol, butylene glycol, decamethylene glycol, and bis-1,4-(hydroxymethyl)cyclohexane. Examples of linear terephthalate polyesters which may be employed include poly(ethylene terephthalate), poly(butylene terephthalate), poly(ethylene terephthalate/5-chloroisophthalate) (85/15), poly(ethylene terephthalate/5-[sodium sulfo]isophthalate) (97/3), poly(cyclohexane-1,4-dimethylene terephthalate), and poly(cyclohexane-1,4-dimethylene terephthalate/hexahydroterephthalate)(75/25).

EXAMPLE 1

For comparative testing, a polyethylene terephthalate yarn was prepared substantially in accordance with one procedure described in U.S. Pat. No. 3,672,977, i.e., an 840 denier, 70 filament yarn was prepared comprised of polyethylene terephthalate filaments treated with about 0.45 percent based on the weight of the yarn of a liquid spin finish consisting of 15 parts refined coconut oil, 15 parts isohexadecyl stearate, 13 parts ethoxylated lauryl alcohol, 10 parts sodium petroleum sulfonate, 5 parts ethoxylated tallow amine, 2 parts of sodium salt of sulfonated succinic ester, and 40 parts mineral oil having a boiling point of between about 265° C. (510° F.) and 327° C. (620° F.). Drawing performance of the yarn was excellent. Finish oil on the fiber was 0.2 weight percent.

To this yarn a secondary finish, or overfinish, identified as Formulation A of Table I, was applied at a 3.0 percent total wet pickup. This sample was identified as yarn A and is the control, i.e., the standard seat belt yarn used in both the warp and filling directions of the seat belt webbing.

An additional sample, yarn B, was prepared with the following changes: the overfinish identified as Formulation B of Table I was applied at a 5.0 percent total wet pickup.

The above yarns were twisted into 2-ply cords with 2.5 twists per inch. One seat belt was woven using cords made entirely from yarn A; this belt, identified as belt 1 is the control. Another belt was woven in which the filling cords (across) were made from yarn B and the warp cords (lengthwise direction) were made from yarn A. This belt is identified as belt 2. In the undyed form there was no significant difference in the appearance or stiffness of the two belts. These belts were woven utilizing a standard shuttle loom.

The belts were then exposed, without dyeing them, to the conditions of the Thermasol Process for dyeing polyester fibers (see above), i.e., the belts were exposed to a temperature of 221° C. maximum for two minutes. The seat belts were then evaluated for stiffness or pliability in the filling direction according to the Pliability of Seat Belt Webbing procedure previously outlined. For comparison, a belt was produced on a needle loom which had almost double the number of picks; the yarn utilized was yarn A twisted into 2-ply cords with no twist. The average pliabilities of these belts are presented in Table II.

EXAMPLE 2

Yarn was prepared as in Example 1, yarn B, except the magnesium chloride solution was replaced with zinc chloride solution, i.e., the overfinish identified as Formulation C of Table I was applied. Belt 3, utilizing this yarn in the filling direction, was made in accordance with Example 1. The average pliability for belt 3 is presented in Table II.

EXAMPLE 3

Yarn was prepared as in Example 1, yarn B, except the water-soluble lubricant, the polyalkylene glycol ether, was omitted from the overfinish, i.e., the over-finish identified as formulation D of Table I was applied. This yarn had very poor (high) yarn to metal friction and could not be twisted into acceptable cord.

EXAMPLE 4

Yarn was prepared as in Example 1, yarn B, except the polyalkylene glycol ether was replaced with polyoxyethylene (400) monolaurate, i.e., the overfinish identified as formulation E of Table I was applied. The average pliability for the resulting belt 4 utilizing the yarn in the filling direction and made in accordance with Example 1 is presented in Table II.

EXAMPLE 5

Yarn was prepared as in Example 1, yarn B, except the overfinish identified as formulation F of Table I was applied. The average pliability of the resulting belt 5 utilizing this yarn in the filling direction and made in accordance with Example 1 is presented in Table II.

EXAMPLE 6

Yarn was prepared as in Example 1, yarn B, except the overfinish identified as formulation G of Table I was applied—note that this formulation is by weight percent, i.e., 20 parts of an acrylic copolymer emulsion (Rhoplex HA-12) was combined with 100 parts of the control overfinish of Example 1. The average pliability for the resulting belt 6 utilizing this yarn in the filling direction and made in accordance with Example 1 is presented in Table II.

EXAMPLE 7

Yarn was prepared as in Example 1, yarn B, except the overfinish identified as formulation H of Table I was applied. The average pliability of the resulting belt 7 utilizing this yarn in the filling direction and made in accordance with Example 1 is presented in Table II.

EXAMPLE 8

Yarn was prepared as in Example 1, yarn B, except the wetting agent was omitted from the overfinish, i.e., the overfinish identified as formulation I was applied. Due to the poor wetting of the lube roll applicator, an uneven application of finish was obtained. No belt was prepared with this sample.

EXAMPLE 9

Yarn was prepared as in Example 1, yarn B, except the overfinish identified as formulation J was applied. The average pliability of the resulting belt 8 utilizing this yarn in the filling direction and made in accordance with Example 1 is presented in Table II.

EXAMPLE 10

Yarn was prepared as in Example 1, yarn B, except the overfinish identified as formulation K was applied at a 2.5 percent wet pickup on the weight of the yarn. Formulations B and K have the same components which vary only in amount. The average pliability of the resulting belt 9 utilizing this yarn in the filling direction and made in accordance with Example 1 is presented in Table II.

Table III demonstrates that the order in which the components of the overfinish are added is important to formulation stability.

EXAMPLE 11

Yarn was prepared as in Example 1, yarn B, except the water-soluble lubricant and wetting agent were omitted, i.e., the overfinish identified as formulation L was applied. Due to high yarn to metal friction, a commercially acceptable cord could not be made.

TABLE II

PLIABILITY

| Sample | Average Pliability |
|---|---|
| Needle loom belt | 885 |
| Belt 1 (control) | 250 |
| Belt 2 | 921 |
| Belt 3 | 905 |
| Belt 4 | 928 |
| Belt 5 | 405 |
| Belt 6 | 365 |
| Belt 7 | 850 |
| Belt 8 | 921 |
| Belt 9 | 921 |

TABLE III

| Component | Order in Which Added | | | | |
|---|---|---|---|---|---|
| AEROTEX Resin 23 LF | 4 | 5 | 4 | 5 | 2 |
| UCON 50 HB-100 | 2 | 2 | 3 | 3 | 4 |
| AEROTEX Accelerator MX | 5 | 4 | 5 | 4 | 3 |
| Nekal WS-25 | 3 | 3 | 2 | 2 | 5 |
| Water | 1 | 1 | 1 | 1 | 1 |
| Formulation Stability | E | E | E | E | P |

E = Excellent - no separation;
Poor - separation

What is claimed is:

1. A synthetic filamentary yarn comprised of polyester filaments which are treated with from about 1.2 to 7.0 weight percent based on the weight of the yarn of a liquid composition comprising about 24 to 86.4 weight percent of water, about 10 to 50 weight percent of a stiffener selected from the group consisting of triazines, melamine, and urea-formaldehyde resins, about 3 to 20 weight percent of a water-soluble lubricant, about 0.4 to

TABLE I

OVERFINISH FORMULATION

| Component | Formulation (by parts) | | | | | | | | | | | |
|---|---|---|---|---|---|---|---|---|---|---|---|---|
| | A | B | C | D | E | F | G | H | I | J | K | L |
| Isohexadecyl Stearate | 19.5 | — | — | — | — | — | 16.2 | — | — | — | — | — |
| Glycerol Monooleate | 1.8 | — | — | — | — | — | 1.5 | — | — | — | — | — |
| Decaglycerol Tetraoleate | 1.5 | — | — | — | — | — | 1.3 | — | — | — | — | — |
| POE(15)[1] Tall Oil Fatty Acid | 2.4 | — | — | — | — | — | 2 | — | — | — | — | — |
| Sulfonated Glycerol Trioleate | 3.6 | — | — | — | — | — | 3 | — | — | — | — | — |
| POE(20)[2] Tallow Amine | 1.2 | — | — | — | — | — | 1 | — | — | — | — | — |
| AEROTEX Resin 23LF[3] | — | 25 | 25 | 26.3 | 25 | — | — | — | 25 | 25 | 50 | 25 |
| UCON 50 HB-100[4] | — | 5 | 5 | — | — | — | — | 5 | 5 | 5 | 10 | — |
| AEROTEX Accelerator MX[5] | — | 1 | — | 1.1 | 1 | — | — | 1 | 1 | 1 | 2 | 1 |
| Nekal WS-25[6] | — | 0.5 | 0.5 | 0.5 | 0.5 | — | — | 0.5 | — | — | 0.5 | — |
| 10% Zinc Chloride Aqueous Solution | — | — | 1 | — | — | — | — | — | — | — | — | — |
| POE (400)[7] Monolaurate | — | — | — | — | 5 | — | — | — | — | — | — | — |
| Acrysol A-1[8] | — | — | — | — | — | 50 | — | — | — | — | — | — |
| Rhoplex HA-12[9] | — | — | — | — | — | — | 16.7 | — | — | — | — | — |
| Trimethylol Melamine Resin | — | — | — | — | — | — | — | 25 | — | — | — | — |
| Triton X-100[10] | — | — | — | — | — | — | — | — | — | 0.5 | — | — |
| Water | 70 | 68.5 | 68.5 | 72.1 | 68.5 | 50 | 58.3 | 68.5 | 69 | 68.5 | 37.5 | 74 |

Footnotes
[1]Fifteen moles of ethylene oxide per mole of fatty acid.
[2]Twenty moles of ethylene oxide per mole of tallow ($C_{14}$–$C_{18}$) amines derived from animal fats.
[3]American Cyanamid Company's trade name for a low free formaldehyde, heterocyclic cross-linking agent with active ingredients of 45 percent.
[4]Union Carbide Corporation's trade name for a water-soluble polyalkylene glycol ether lubricant having a viscosity of 100 SUS at 100° F. (37.8° C.).
[5]American Cyanamid Company's trade name for an aqueous solution comprising 10 percent by weight of magnesium chloride.
[6]GAF's trade name for a solution consisting of 75 percent sodium dinonyl sulfosuccinate, 10 percent isopropanol and 15 percent water.
[7]Nine moles of ethylene oxide per mole of lauric acid.
[8]Rohm & Haas Company's trade name for a polyacrylic acid product with an active ingredient of 25 percent.
[9]Rohm & Haas Company's trade name for an aqueous dispersion of acrylic copolymers.
[10]Rohm & Haas Company's trade name for polyoxyethylene 9–10 octylphenol.

5 weight percent of a catalyst for the stiffener, and about 0.2 to 1 percent of a wetting agent.

2. The yarn of claim 1 wherein said water-soluble lubricant is selected from the group consisting of polyoxyalkylene ethers, ethoxylated esters, polyalkylene glycols and diesters.

3. The yarn of claim 1 wherein said water-soluble lubricant is a polyalkylene glycol ether.

4. The yarn of claim 1 wherein said water-soluble lubricant is polyoxyethylene (400) monolaurate.

5. The yarn of claim 1 wherein said water-soluble lubricant is polyoxyethylene (400) pelargonate.

6. The yarn of claim 1 wherein said catalyst is an aqueous solution of magnesium chloride.

7. The yarn of claim 1 wherein said catalyst is an aqueous solution of zinc chloride.

8. The yarn of claim 1 wherein said wetting agent is a salt of dinonyl sulfosuccinate.

9. The yarn of claim 1 wherein said wetting agent is polyoxyethylene 9–10 octylphenol.

10. The yarn of claim 1 wherein the polyester filaments, prior to treatment with said liquid composition, are treated with from about 0.3 to 0.6 weight percent based on the weight of the yarn of another liquid composition comprising about 10 to 20 weight percent of isohexadecyl stearate, about 10 to 20 weight percent of refined coconut oil, about 3.0 to 6.0 weight percent of ethoxylated tallow amine, about 10 to 20 weight percent of ethoxylated lauryl alcohol, about 8.0 to 12.0 weight percent of a salt of alkylarylsulfonate, about 1.0 to 3.0 weight percent of a sulfonated succinic ester, and about 35 to 50 weight percent of white mineral oil having a boiling point of between about 265° C. (510° F.) and 327° C. (620° F.) and a viscosity of about 38 to 40 SUS at about 38° C. (100° F.) wherein at least about 0.15 to about 0.30 weight percent is retained on the said yarn.

11. A synthetic filamentary yarn comprised of polyethylene terephthalate filaments which are treated with from about 2.5 to 3.0 weight percent based on the weight of the yarn of a liquid composition comprising about 24 to 86.4 weight percent of water, about 10 to 50 weight percent of a modified melamine urea resin, about 3 to 20 weight percent of a polyalkylene glycol ether, about 0.4 to 5 weight percent of an aqueous solution of magnesium chloride, and about 0.2 to 1 weight percent of a salt of dinonyl sulfosuccinate.

12. The yarn of claim 11 wherein the polyethylene terephthalate filaments, prior to treatment with said liquid composition, are treated with from about 0.3 to 0.6 weight percent based on the weight of the yarn of another liquid composition comprising about 10 to 20 weight percent isohexadecyl stearate, about 10 to 20 weight percent of refined coconut oil, about 3.0 to 6.0 weight percent of ethoxylated tallow amine, about 10 to 20 weight percent of ethoxylated lauryl alcohol, about 8.0 to 12.0 weight percent of a petroleum sulfonate, about 1.0 to 3.0 weight percent of a salt of dinonyl sulfosuccinate, and about 35 to 50 weight percent of white mineral oil having a boiling point of between about 265° C. (510° F.) and 327° C. (620° F.) and a viscosity of about 38 to 40 SUS at about 38° C. (100° F.) wherein at least about 0.15 to about 0.30 weight percent is retained on said yarn.

13. A fiber finish composition, particularly for application to polyester yarn prepared by a process involving spinning and drawing steps, said composition comprising: about 24 to 86.4 percent of water, about 10 to 50 weight percent of a stiffener selected from the group consisting of triazines, melamine and urea-formaldehyde resins, about 3 to 20 weight percent of a water-soluble lubricant, about 0.4 to 5 weight percent of a catalyst for the stiffener, and about 0.2 to 1 weight percent of a wetting agent, said composition being applied as an overfinish to the yarn after drawing the yarn.

14. The fiber finish composition of claim 13 wherein said water-soluble lubricant is selected from the group consisting of polyoxyalkylene ethers, ethoxylated esters, polyalkylene glycols and diesters.

15. The fiber finish composition of claim 13 wherein said water-soluble lubricant is a polyalkylene glycol ether.

16. The fiber finish composition of claim 13 wherein said water-soluble lubricant is polyoxyethylene (400) monolaurate.

17. The fiber finish composition of claim 13 wherein said water-soluble lubricant is polyoxyethylene (400) pelargonate.

18. The fiber finish composition of claim 13 wherein said catalyst is an aqueous solution of magnesium chloride.

19. The fiber finish composition of claim 13 wherein said catalyst is an aqueous solution of zinc chloride.

20. The fiber finish composition of claim 13 wherein said wetting agent is a salt of dinonyl sulfosuccinate.

21. The fiber finish composition of claim 13 wherein said wetting agent is polyoxyethylene 9–10 octylphenol.

22. The method of formulating the finish composition of claim 13, comprising the steps of:

(a) adding the water-soluble lubricant to the water;
(b) then adding the wetting agent to the water-soluble lubricant and water;
(c) then adding the stiffener thereto; and
(d) finally adding the catalyst thereto.

23. The method of formulating the finish composition of claim 13, comprising the steps of:

(a) adding the water-soluble lubricant to the water;
(b) then adding the wetting agent to the water-soluble lubricant and water;
(c) then adding the catalyst thereto; and
(d) finally adding the stiffener thereto.

24. The method of formulating the finish composition of claim 13, comprising the steps of:

(a) adding the wetting agent to the water;
(b) then adding the water-soluble lubricant to the wetting agent and water;
(c) then adding the stiffener thereto; and
(d) finally adding the catalyst thereto.

25. The method of formulating the finish composition of claim 13, comprising the steps of:

(a) adding the wetting agent to the water;
(b) then adding the water-soluble lubricant to the wetting agent and water;
(c) then adding the catalyst thereto; and
(d) finally adding the stiffener thereto.

26. A fiber finish composition, particularly for application to polyethylene terephthalate yarn prepared by a process involving spinning and drawing steps, said composition comprising: about 24 to 86.4 weight percent of water, about 10 to 50 weight percent of a modified melamine urea resin, about 3 to 20 weight percent of a polyalkylene glycol ether, about 0.4 to 5 weight percent of an aqueous solution of magnesium chloride, and about 0.2 to 1 weight percent of a salt of dinonyl sulfosuccinate, said composition being appllied as an overfinish to the yarn after drawing the yarn.

27. The method of formulating the finish composition of claim 26, comprising the steps of:
(a) adding the polyalkylene glycol ether to the water;
(b) then adding the salt of dinonyl sulfosuccinate to the polyalkylene glycol ether and water;
(c) then adding the modified melamine urea resin to the other components; and
(d) finally adding the aqueous solution containing magnesium chloride thereto.

28. The method of formulating the finish composition of claim 26, comprising the steps of:
(a) adding the polyalkylene glycol ether to the water;
(b) then adding the salt of dinonyl sulfosuccinate to the polyalkylene glycol ether and water;
(c) then adding the aqueous solution containing magnesium chloride to the other components; and
(d) finally adding the modified melamine urea resin thereto.

29. The method of formulating the finish composition of claim 26, comprising the steps of:
(a) adding the salt of dinonyl sulfosuccinate to the water;
(b) then adding the polyalkylene glycol ether to the salt of dinonyl sulfosuccinate and water;
(c) then adding the modified melamine urea resin to the other components; and
(d) finally adding the aqueous solution containing magnesium chloride thereto.

30. The method of formulating the finish composition of claim 26, comprising the steps of:
(a) adding the salt of dinonyl sulfosuccinate to the water;
(b) then adding the polyalkylene glycol ether to the salt of dinonyl sulfosuccinate and water;
(c) then adding the aqueous solution containing magnesium chloride to the other components; and
(d) finally adding the modified melamine urea resin thereto.

31. In a process for the production of a woven fabric wherein the cords of at least one weaving direction of the fabric are made from a polyester yarn, the yarn being prepared by a process involving spinning and drawing steps, the improvement which comprises:
(a) treating the yarn subsequent to the drawing step with from about 1.2 to 7.0 weight percent based on the weight of the yarn of a liquid composition comprising about 24 to 86.4 weight percent of water, about 10 to 50 weight percent of a stiffener selected from the group consisting of triazines, melamine and urea-formaldehyde resins, about 3 to 20 weight percent of a water-soluble lubricant, about 0.4 to 5 weight percent of a catalyst for the stiffener, and about 0.2 to 1 weight percent of a wetting agent;
(b) twisting the yarn into cord;
(c) weaving a fabric which utilizes the treated cords in at least one weaving direction; and
(d) exposing the fabric for an effective time period to a temperature which causes the composition to stiffen the fabric.

32. The process of claim 31 wherein said water-soluble lubricant is selected from the group consisting of polyoxyalkylene ethers, ethoxylated esters, polyalkylene glycols and diesters.

33. The process of claim 31 wherein said water-soluble lubricant is a polyalkylene glycol ether.

34. The process of claim 31 wherein said water-soluble lubricant is polyoxyethylene (400) monolaurate.

35. The process of claim 31 wherein said water-soluble lubricant is polyoxyethylene (400) pelargonate.

36. The process of claim 31 wherein said catalyst is an aqueous solution of magnesium chloride.

37. The process of claim 31 wherein said catalyst is an aqueous solution of zinc chloride.

38. The process of claim 31 wherein said wetting agent is a salt of dinonyl sulfosuccinate.

39. The process of claim 31 wherein said wetting agent is polyoxyethylene 9–10 octylphenol.

40. The process of claim 31 wherein the improvement further comprises the step of treating the yarn during the spinning step with from about 0.3 to about 0.6 weight percent based on the weight of the yarn of a liquid composition comprising about 10 to 20 weight percent of isohexadecyl stearate, about 10 to 20 weight percent of refined coconut oil, about 3 to 6 weight percent of ethoxylated tallow amine, about 10 to 20 weight percent of ethoxylated lauryl alcohol, about 8 to 12 weight percent of a salt of alkylarylsulfonate, about 1 to 3 weight percent of a sulfonated succinic ester, and about 35 to 50 weight percent of white mineral oil having a boiling point of between about 265° C. (510° F.) and 327° C. (620° F.) and a viscosity of about 38 to 40 SUS at about 38° C. (100° F.) wherein at least about 0.15 to about 0.30 weight percent is retained on the yarn.

41. In a process for the production of a woven fabric wherein the cords of at least one weaving direction of the fabric are made from polyethylene terephthalate yarn, the yarn being prepared by a process involving spinning and drawing steps, the improvement which comprises:
(a) treating the yarn subsequent to the drawing step with from about 2.5 to 3.0 weight percent based on the weight of the yarn of a liquid composition comprising about 24 to 86.4 weight percent of water, about 10 to 50 weight percent of a modified melamine urea resin, about 3 to 20 weight percent of a polyalkylene glycol ether, about 0.4 to 5 weight percent of an aqueous solution of magnesium chloride, and about 0.2 to 1 weight percent of a salt of dinonyl sulfosuccinate;
(b) twisting the yarn into cord;
(c) weaving a fabric which utilizes the treated cords in at least one weaving direction; and
(d) exposing the fabric for about 1 to 1.5 minutes to a temperature of at least about 171° C. (340° F.) to cause crosslinking of the resin which stiffens the fabric.

42. The process of claim 41 wherein the improvement further comprises the step of treating the yarn during the spinning step with from about 0.3 to about 0.6 weight percent based on the weight of the yarn of a liquid composition comprising about 10 to 20 weight percent of isohexadecyl stearate, about 10 to 20 weight percent of refined coconut oil, about 3 to 6 weight percent of ethoxylated lauryl alcohol, about 8 to 12 weight percent of a petroleum sulfonate, about 1 to 3 weight percent of a salt of dinonyl sulfosuccinate, and about 35 to 50 weight percent of white mineral oil having a boiling point of between about 265° C. (510° F.) and 327° C. (620° F.) and a viscosity of about 38 to 40 SUS at about 38° C. (100° F.) wherein at least about 0.15 to about 0.30 weight percent is retained on the yarn.

* * * * *